United States Patent [19]

Romanauskas

[11] Patent Number: 4,552,278

[45] Date of Patent: Nov. 12, 1985

[54] CRIMPABLE CAPPING ASSEMBLY FOR A CENTRIFUGE TUBE

[75] Inventor: William A. Romanauskas, Southbury, Conn.

[73] Assignee: E. I. Du Pont de Nemours and Company, Wilmington, Del.

[21] Appl. No.: 666,616

[22] Filed: Oct. 30, 1984

[51] Int. Cl.[4] ..... B65D 45/02

[52] U.S. Cl. ..... 215/277; 53/486; 215/325

[58] Field of Search ..... 215/325, 277; 220/256; 53/486

[56] References Cited

U.S. PATENT DOCUMENTS

| | | | |
|---|---|---|---|
| 789,590 | 5/1905 | Coale et al. . | |
| 802,690 | 10/1905 | Hicks . | |
| 1,257,628 | 2/1918 | Murphy . | |
| 2,175,350 | 10/1939 | Hammer | 215/325 |
| 2,307,181 | 1/1943 | Young . | |
| 2,735,149 | 2/1956 | Frank . | |
| 3,011,690 | 12/1961 | Gabuzda . | |
| 3,308,936 | 3/1967 | Roland et al. . | |
| 3,366,320 | 1/1968 | Cho . | |
| 3,424,218 | 1/1969 | Vanderbur, Jr. et al. . | |
| 3,454,178 | 7/1969 | Bender et al. . | |
| 3,574,333 | 4/1971 | Ohara . | |
| 3,635,370 | 1/1972 | Romanauskas . | |
| 3,712,498 | 1/1973 | Lawrence . | |
| 3,810,503 | 5/1974 | Lewis, Jr. et al. . | |
| 3,866,794 | 2/1975 | Kerr | 220/256 X |
| 4,166,573 | 9/1979 | Webster . | |
| 4,190,196 | 2/1980 | Larsen . | |
| 4,222,513 | 9/1980 | Webster et al. . | |
| 4,285,904 | 8/1981 | Ishimaru et al. . | |
| 4,301,963 | 11/1981 | Nielsen . | |

FOREIGN PATENT DOCUMENTS

| | | |
|---|---|---|
| 679277 | 2/1964 | Canada . |
| 701286 | 12/1963 | United Kingdom . |
| 920207 | 3/1966 | United Kingdom . |

*Primary Examiner*—Donald F. Norton

[57] ABSTRACT

A separate capping assembly for a centrifuge tube includes a stopper having a plug adapted for close fitting receipt on the interior of the neck of the tube being sealed and a complimentary tubular sleeve sized for close fitting receipt over the exterior of the tube neck. The sleeve is responsive to a radially inwardly directed force by deformably crimping to compress the material of the neck of the bottle into an annular seal defined between the plug and the sleeve. The annular seal so formed resists fluid leakage from the interior of the tube during centrifugation of the tube.

8 Claims, 5 Drawing Figures

74
82
80
78
76
84
100
86
98
66
90
90
88
102
106
96
92
99
96R
96L
96L
38A
96R
12
38B
12
10
10
110
72

CRIMPABLE CAPPING ASSEMBLY FOR A CENTRIFUGE TUBE

BACKGROUND OF THE INVENTION

1. Field of the Invention

The present invention relates to a tube capping assembly for use with a centrifuge tube and, in particular, to a tube capping assembly which includes a crimpably deformable element.

2. Description of the Prior Art

During a centrifugation run a sample container that carries a liquid sample of a material under test is exposed to forces which range up to several hundred thousand times the force exerted due to gravity. Accordingly, extreme care must be exercised in the design of sample container closure systems in order to withstand this extreme operating environment.

When open mouth test tube-like sample containers are utilized closure members for these containers typically include a central portion which projects inwardly into the mouth of the sample container. The central portion acts against the upper end of the sample container to urge the same into compressive contact with an outer cap. Typically further, the cap assembly may be threadedly secured into the body of the ultracentrifuge rotor to maintain the sealed integrity of the interface so established. Exemplary of such open mouth sample closure systems are those shown in U.S. Pat. No. 3,635,370 (Romanauskas), U.S. Pat. No. 4,166,573 (Webster), U.S. Pat. No. 4,190,196 (Larsen) and U.S. Pat. No. 4,222,513 (Webster et al.), all of which are assigned to the assignee of the present invention.

Closure assemblies for open mouth threaded bottles have also been used in confining a sample under test within the interior of the bottle. Exemplary of such devices are those shown in U.S. Pat. No. 3,366,320 (Cho).

The prior art also discloses an arrangement whereby a separate closure assembly for the sample container is not required. Exemplary of such an arrangement is a sample container such as that disclosed in U.S. Pat. No. 4,301,963 (Nielson). Such a container is heat sealable in the manner disclosed in U.S. Pat. No. 4,291,964 (Ishimaru).

Each of the above mentioned techniques of closure of the sample container has certain perceived disadvantages. For example, the closure assembly adapted for use with an open mouth test tube-like container is often relatively complex and time consuming to use. Threaded closure arrangements are prone to leakage. Heat sealing techniques suffer the perceived disadvantage of exposing the sample under test to the potentially harmful effects of the heat when the container is sealed.

Accordingly, it is believed advantageous to provide a separate capping assembly for a sample container which, once a seal for the container is effected, maintains the sealed integrity so established despite exposure to the extreme force fields attendent with ultracentrifugation. Moreover, it is believed advantageous to provide a capping assembly which does not use heat fusion and thereby avoids the potentially deleterious effects that are entailed by the exposure of the sample under test to the heat necessary for fusion of the container.

SUMMARY OF THE INVENTION

The present invention relates to a separate capping assembly for use with a centrifuge sample tube formed from a suitable predetermined plastic or thermoplastic material. The tube includes a substantially cylindrical body portion having a hemispherical bottom and a reduced diameter coaxially disposed neck portion which is connected to the body portion through a frustoconical transition region. The neck defines a fluid port. The separate capping assembly comprises a stopper having a plug portion with a flange at one end thereof and a complimentary crimpably deformable sleeve. The plug is sized for close fitting receipt on the interior of the tube neck with the flange providing a suitable stop which limits the degree of entry of the plug into the neck. The sleeve, which may be a cylindrical tubular member open at both ends or, if desired, closed at one end, is slidably received in close fitting contact over the exterior of the neck in concentric telescopic relationship with respect to the plug. The sleeve is responsive to a radially inwardly directed force imposed thereon to crimpably deform to compress the material in the neck of the tube into sealed engagement with the plug. The annular seal so formed resists fluid leakage out of the tube. The radially inwardly directed crimping force may be applied at a plurality of spaced axial locations on the neck by the use of any suitable crimping tool.

BRIEF DESCRIPTION OF THE DRAWINGS

This invention may be more fully understood from the following detailed description thereof taken in connection with the accompanying drawings which form a part of this application and in which.

DETAILED DESCRIPTION OF THE INVENTION

Figure 1:
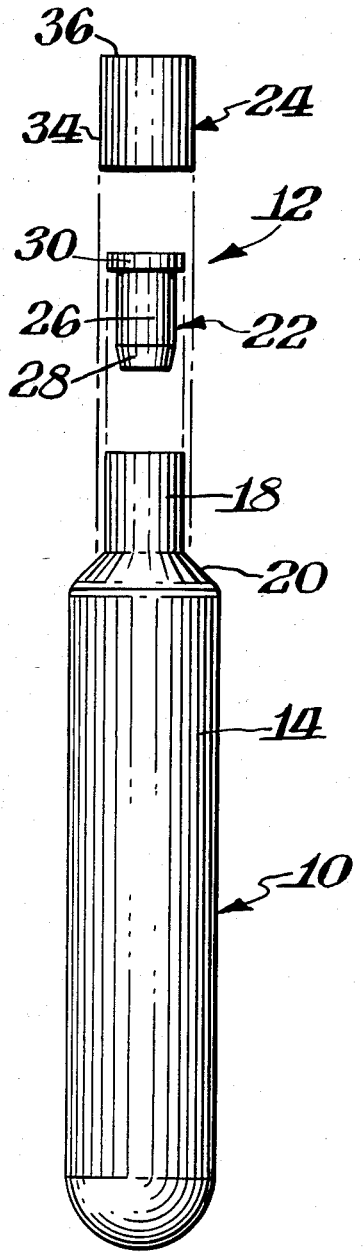
FIG. 1 is an exploded perspective view of a centrifuge tube and a separate capping assembly in accordance with the present invention.
Figure 2:
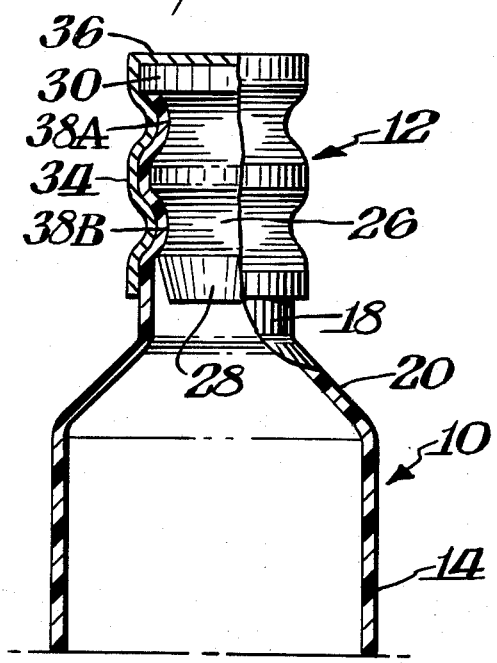
FIG. 2 is an enlarged elevational view partially in section illustrating the tube capping assembly in its assembled and sealed relationship with respect to the centrifuge tube.

Throughout the following detailed description similar reference numerals refer to similar elements in all figures of the drawings.

Shown in FIG. 1 is an ultracentrifuge tube generally indicated by reference character 10 with which a separate tube capping assembly generally indicated by reference character 12 in accordance with the present invention may be utilized. The tube 10, in the preferred case, includes a substantially cylindrical main body portion 14 having an integral hemispherical bottom 16 and a reduced diameter neck portion 18 integrally connected to the body portion 14 through a frustoconical transition region 20. The tube 10 is preferably an extrusion-blow molded member formed of a polyallomer plastic material. Of course, tube 10 can be formed of other deformable material by other molding techniques, such as injection blow molding. The main body portion defines a fluid capacity of any predetermined volume dependent upon the volumetric size of the samples which are to be carried therewithin for centrifugation.

The neck 18 defines a fluid port through which a liquid sample under test may be introduced into the tube 10.

The separate capping assembly 12 comprises a stopper 22 and a complimentary sleeve 24. The stopper 22 includes a projecting elongated plug portion 26 having a tapered end 28 and a flange 30 disposed at one end thereof. The external configuration of the plug portion 26 is configured and sized for close fitting receipt within the neck 18 of the tube 10. The flange 30 serves to limit the extent of entry of the plug portion 26 of the stopper 22 into the neck 18. Preferably the dimension of the flange 30 is coextensive with the exterior dimension of the neck. In a preferred case, the stopper 22 is compression molded of an elastomeric material such as Buna-N rubber having a specific gravity of 1.09. Functionally, the stopper 22 should be fabricated of a material which is hard enough and strong enough to minimize deformation during centrifugation yet be sufficiently resilient to conform to the crimped configuration of the tube as will be developed herein.

The sleeve 24 includes a tubular skirt portion 34 which, in the preferred case, is closed at one end, as at 36. It is also within the contemplation of this invention to use an open end tubular sleeve. The interior of the skirt portion 34 of the sleeve 24 is sized and configured for close fitting receipt over the exterior of the neck 18 of the tube 10. The skirt 34 has an axial length sufficient to dispose the sleeve 24 in concentric telescopic relationship with a predetermined portion of the length of the plug 26 as the stopper 22 is received within the neck. The sleeve 24 is formed of aluminum or any crimpably deformable material having sufficient strength to minimize deformation during centrifugation.

In operation, a sample of the material under test is inserted into the tube 10 and the stopper 22 thereafter inserted into the neck 18 until the entry thereof is limited by the abutment of the flange 30 against the upper end of the tube neck 18. The flange 30 has a diametrical dimension that is coextensive with the exterior dimension of the neck 18. Any other suitable insertion limiting expedient, such as a radially projecting pinlike protrusion which does not extend around the full circumference of the base of the plug 26 may, of course, also be utilized and remain within the contemplation of the present invention.

With the stopper 22 so inserted into the neck 18 of the tube 10 the sleeve 24 is telescopically inserted over the neck 18 so that the skirt 34 concentrically overlaps a portion of the length of the plug portion 26 of the stopper 22.

With the stopper 22 and the sleeve 24 in the above described assembled relationship a radially inwardly directed crimping force is circumferentially applied about the exterior of the skirt portion 34 of the sleeve 24 using a tool to be described. The skirt portion 34 of the sleeve 24 responds to the radially directed crimping force by crimpingly deforming to compress the material in the neck 18 of the tube 10 intermediate the plug 26 and the skirt 34. The radially inwardly directed crimping force is imposed at at least one but preferably at a plurality of spaced axial locations along the neck 18. As a result of the imposition of the radially directed crimping force at least one but preferably a plurality of circumferentially extending sealed interfaces 38A, 38B are defined between the neck 18 and the plug 26 at each location at which the crimping force is applied due to the compression of the material of the neck 18 between the plug 22 and the skirt 34. The seals 38A and 38B developed in the manner described are each able to resist the pressure of the liquid within the tube 10 to thereby resist fluid leakage during centrifugation.

Figure 3:
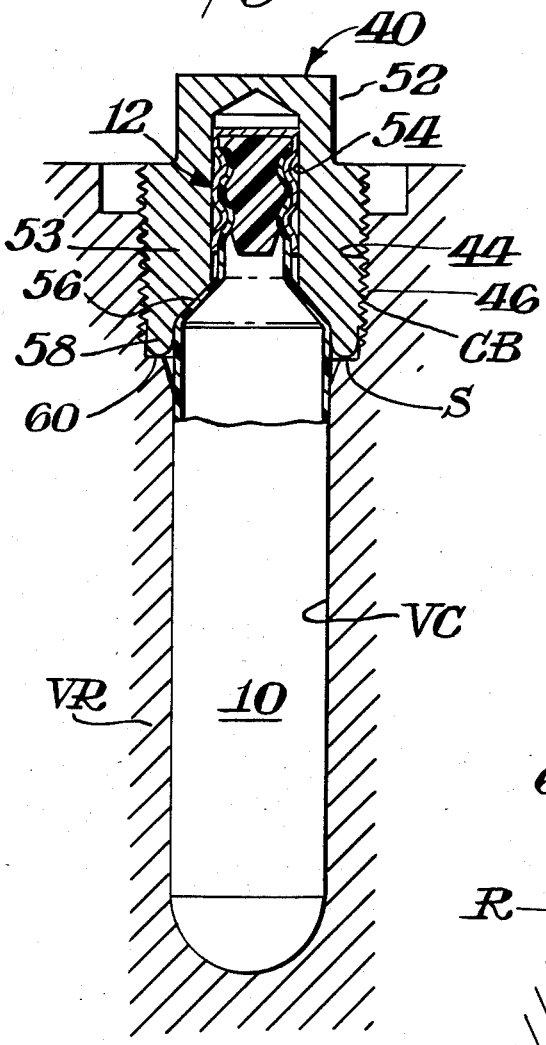
FIGS. 3 and 4 are side elevational views, in section, of a sealed tube supported in a cavity of a vertical and fixed angle rotor, respectively.
Figure 4:
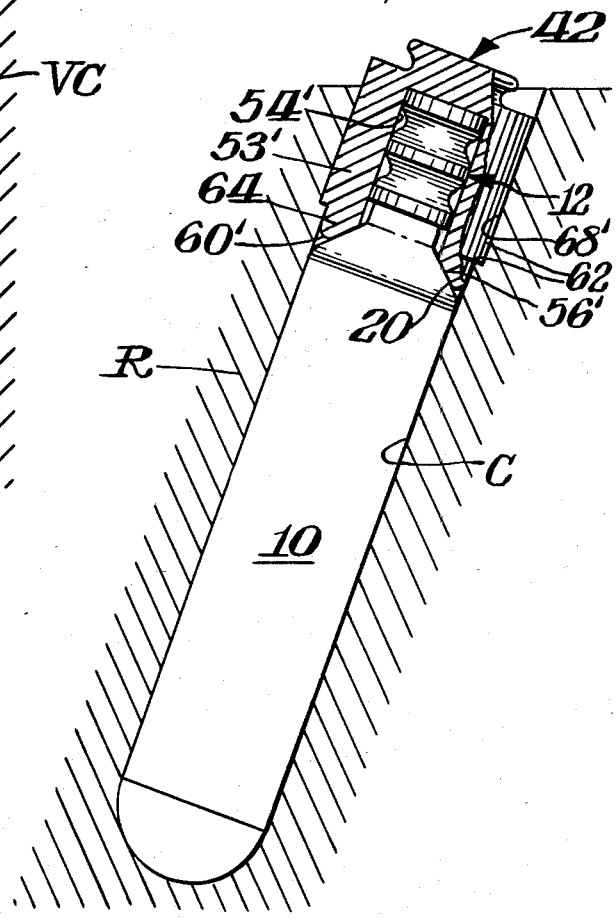

After forming the crimp seal in a manner above described, sealed tubes can be inserted for centrifugation into a vertical cavity VC in a vertical rotor VR (FIG. 3) or into the cavity C of a fixed angle centrifuge rotor R (FIG. 4). The tube 10 is supported using a suitable rotor cap 40 or 42, respectively shown in FIGS. 3 and 4.

A threaded rotor cap 40 such as that shown in FIG. 3 is used for a vertical rotor VR. Threads 44 are formed on the exterior of the rotor cap 40 and engage threads 46 arranged in a counterbore CB provided at the head of the cavity VC in the rotor VR which accepts the tube 10. A boss 52 on the rotor cap 40 facilitates threading. The rotor cap 40 is provided with a main body portion 53 having a central bore 54, a frustoconical region 56 and an annular flange 58 terminating in a rounded or other nonplanar surface 60. The rotor cap 40 is threaded into the rotor until the surface 60 abuts a shoulder S which defines the counterbore CB and thus does not extend into the cavity VC. In this position the sealed neck of the tube 10 projects into the bore 54 and the transition region 20 is supported by the frustoconical region 56.

A fixed angle rotor R as shown in FIG. 4 requires a rotor cap 42 which is free floating in the counterbore CB′ provided at the upper end of the rotor cavity C. Such a rotor cap 42 supports the tube 10 and minimizes the distortion due to centrifugal force and resists the hydraulic pressure in the tube resulting from centrifugation which, if unopposed, would rupture the tube. The rotor cap 42 is provided with an annular shoulder 62 which seats on the shoulder S of the counterbore CB′ of the rotor cavity C. The main body portion 53′ of the rotor cap 42 has a central bore 54′ and a skirt portion 64 that terminates in the rounded or nonplanar surface 60′. The skirt portion 64 has a frustoconical surface 56′. The skirt portion 64 projects into the cavity C so that the surface 56′ supports the transition region 20 of the tube 10. Circumferential support for the tube 10 below the transition region 20 is supplied by the boundary of the cavity C of the rotor R. Abutment of the shoulder 62 with the shoulder S′ prevents entry of the rotor cap 42 into the cavity C.

Figure 5:
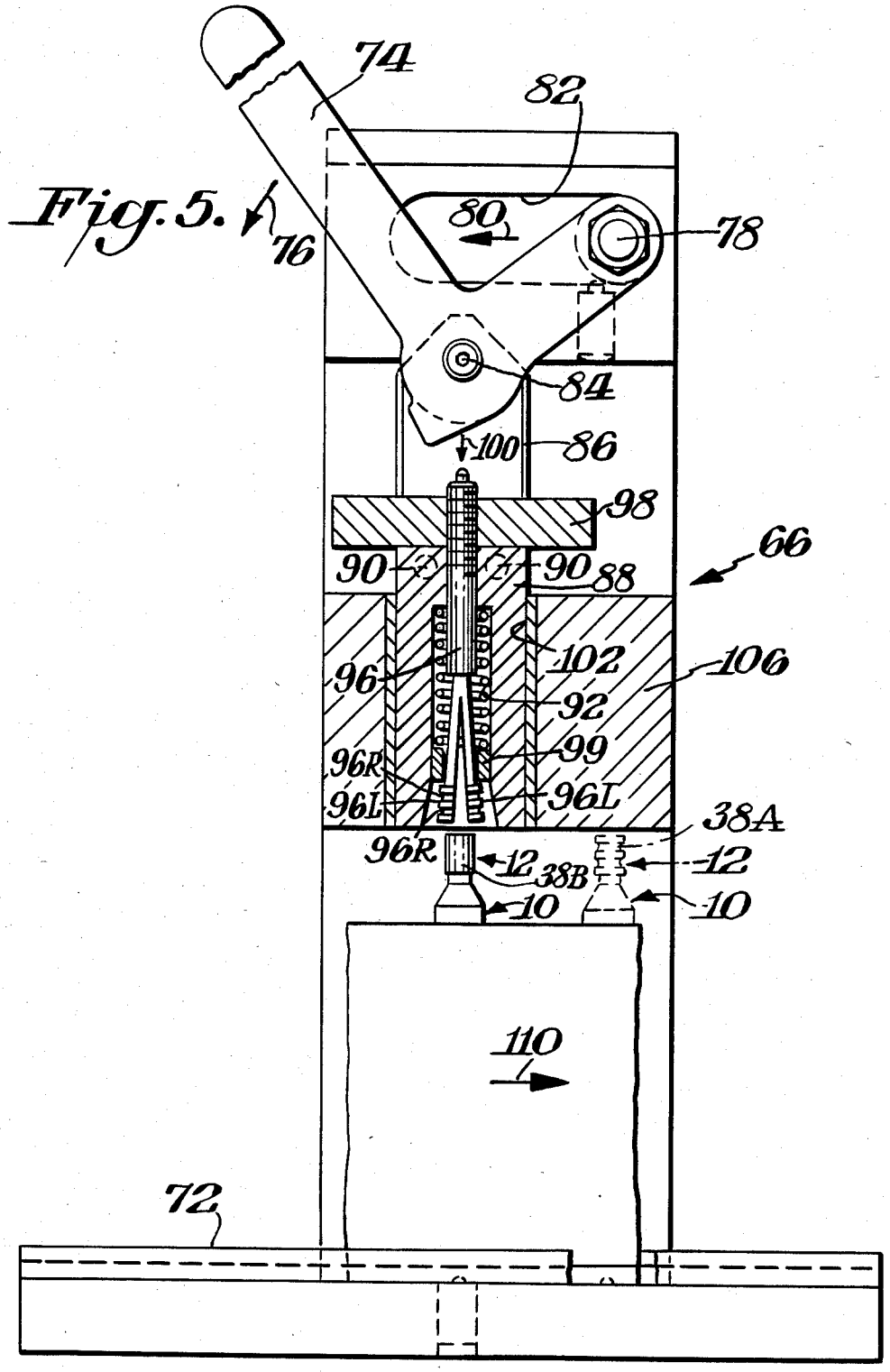
FIG. 5 is a view of a tool useful to impose a crimping force to deform the capping assembly in accordance with the present invention.

The radially directed crimping force may be applied by any suitable means. However, FIG. 5 shows a sectional view of the main functional elements of a preferred crimping tool 66. The tool 66 is shown as table mounted although it may be implemented as a hand held device if preferred. Motive force for the crimping tool may be manually, electrically, pneumatically or otherwise.

With reference to FIG. 5, the tube 10 to be sealed is inserted into the crimping tool 66 using a suitable guide rail arrangement 72 which supplies the necessary accurate location of the tube 10 being sealed with respect to the crimping element to be described. Once in position, a handle 74 is displaced from the initial position to an operating position and returned in a smoothly continuous operating stroke in order to effect the crimping and release of the tube.

In operation, as the handle 74 is displaced in the direction of the arrow 76 from the initial to the crimping position, a cam follower 78 moves in the direction of the arrow 80 within a cam track 82 provided in the superstructure of the crimping tool 66. The handle 74 is pivotally mounted as at 84 to the ears 86 of a crimper yoke 88. The yoke 88 is suitably fastened, as at 90, at each side thereof to an ear 86. Only one ear 86 is shown in the sectinal view of FIG. 5. The yoke 88 has a counterbored central recess 92 therein. A collet 96 with four split legs 96L (only two of which are visible) is received within the bore 92. The collet 96 is threadedly attached to a collet holder 98 which rests atop the crimper yoke 88. A spring loaded crimping collar 99 is also carried within the bore 92.

As the handle 74 is displaced toward the crimping position, the pivot point 84 is lowered in the direction of the arrow 100. The vertical motion of the crimper yoke 88 is guided within a lined bore 102 extending through a guide block 106. After a predetermined travel of the yoke 88 the undersurface of the collet holder 98 contacts the upper surface of the guide block 106 to arrest the motion of the collet holder 98 and the collet 96 connected thereto. The ringed legs 96L of the collet 96 now surround the sleeve 34 of the tube 10 to be capped.

Continued movement of the handle 74 carries the crimper yoke 88 downwardly, loading the collar 99 but eventually forcing the collar 99 against the outside conical surface of the collet legs 96L. The inner surface of the collet legs 96L are provided with a predetermined number of rings 96R corresponding in number to the number of crimped seals 38 being effected. The inner surface of each of the collet legs 96L contacts the sleeve 34 bringing the rings 96R on the collet legs 96L into contact with the surface of the sleeve 34 and thereby imposing the radially inwardly directed crimping force thereon. At the bottom of the stroke the legs of the collet 96L have closed to the point of slightly reducing the diameter of the entire length of the sleeve 34 as well as forming the crimped seals 38A, 38B discussed above. To insure that each seal 38A and 38B is true circular the collet 96 is saw cut axially to define the legs 96L. The inner diameter of the collet 96 is then finished to define the rings 96R.

Once the bottom of the stroke has been reached the handle 74 is returned to the initial position raising the crimper yoke 88. The spring loaded collar 99 holds the collet 96 down until the collet holder 98 is contacted by the upper surface of the crimper yoke 88. At this point the collet legs 96L are fully opened and can be lifted off the capped tube. The handle 74 is returned to the initial position and may be locked at that position by a detent and pneumatic spring plunger (not shown). The sealed tube is thereafter advanced removed from the clamper device, a new tube is displaced in the direction of the arrow 110 and is brought into position and the process repeated.

Those skilled in the art may readily appreciate that a separate capping assembly for a centrifuge tube has been provided would provide an efficient and expeditious sealed interface for the tube without the use of heat sealing and the attendent exposure of the contents of the sample in the tube to the potentially deleterious effects of heat. Those skilled in the art having benefit of the teachings of the present invention as hereinabove set forth may effect numerous modifications thereto. These modifications are, however, to be construed as lying within the scope of the present invention as defined in the appended claims.

What is claimed is:

1. A capping assembly for use with a centrifuge tube formed of a deformable material, the tube having a neck portion which defines a fluid port, the neck having a predetermined interior and exterior, the capping assembly comprising:

a stopper having a plug portion sized and configured for close fitting receipt on the interior of the neck; and a sleeve sized and configured for close fitting receipt over the exterior of the neck in concentric telescopic relationship with respect to the plug, the sleeve being responsive to a crimping force to deform and compress the material of the neck intermediate the plug and the sleeve to form an annular seal between the neck and the plug which resists fluid leakage out of the fluid port from the interior of the tube.

2. The apparatus of claim 1 further comprising a flange disposed on the stopper to limit a degree of insertion of the stopper into the neck of the tube.

3. The apparatus of claim 2 wherein the flange has an exterior dimension coextensive with the exterior dimension of the neck.

4. The apparatus of claim 2 wherein the sleeve is closed at one end thereof.

5. The apparatus of claim 3 wherein the sleeve is closed at one end thereof.

6. A method for sealing a centrifuge tube having a neck formed of a deformable material comprising the steps of a. inserting a plug into the neck of the tube for a predetermined distance;

b. disposing a sleeve in a close fitting relationship over the exterior of the neck in concentric telescopic relationship with respect to the plug; and c. imposing a crimping force onto the sleeve to compress the material of the neck intermediate the plug and the sleeve to form an annular seal between the neck and the plug sufficient to resist leakage of a fluid from the interior of the tube.

7. The method of claim 6 wherein the crimping force is imposed at a first and a second axially spaced location on the sleeve.

8. The method of claim 7 wherein the crimping force is simultaneously imposed at each of the spaced axial locations on the sleeve.

* * * * *